US005284203A

United States Patent [19]

Dauvergne

[11] Patent Number: 5,284,203

[45] Date of Patent: Feb. 8, 1994

[54] FLUID HEADER WITH AN INTEGRAL EXPANSION CHAMBER FOR A HEAT EXCHANGER, IN PARTICULAR FOR A MOTOR VEHICLE

[75] Inventor: Jean Dauvergne, Fosses, France

[73] Assignee: Valeo Thermique Moteur, Le Mesnil-Saint-Denis, France

[21] Appl. No.: 60,747

[22] Filed: May 12, 1993

[30] Foreign Application Priority Data

May 13, 1992 [FR] France ..... 92 05808

[51] Int. Cl.[5] ..... F28F 9/22

[52] U.S. Cl. ..... 165/174; 165/153

[58] Field of Search ..... 165/153, 173, 174

[56] References Cited

U.S. PATENT DOCUMENTS

| | | | |
|---|---|---|---|
| 3,731,734 | 5/1973 | Ris et al. | 165/174 X |
| 4,141,409 | 2/1979 | Woodhull, Jr. et al. | 165/174 X |
| 4,216,764 | 8/1980 | Clark | 165/174 X |
| 4,243,094 | 1/1981 | Woodhull, Jr. et al. | 165/174 X |
| 4,309,987 | 1/1982 | Higgins, Jr. | 165/174 X |
| 4,407,269 | 10/1983 | Hopper | 165/174 X |
| 4,940,086 | 7/1990 | Stay | 165/174 X |

FOREIGN PATENT DOCUMENTS 2443657 11/1979 France .

2486814 7/1980 France .

*Primary Examiner*—John Rivell

*Attorney, Agent, or Firm*—Morgan & Finnegan

[57] ABSTRACT

A heat exchanger, typically a cooling radiator for an internal combustion engine of a motor vehicle, has a water header with an integral expansion chamber. The header comprises a header body or casing having an elongated open bottom face closed by a header plate, which is fixed to the header body. Liquid flows in the header between a first end and a second end of the latter, so as to cover the header plate. The header body has a set of transverse, integral baffles spaced apart along the header body between its two ends. Each baffle has a free edge close to the header plate and an opening defining a flow cross section through the baffle. The area of this opening decreases in successive baffles in the direction of flow.

9 Claims, 2 Drawing Sheets

FIG.3
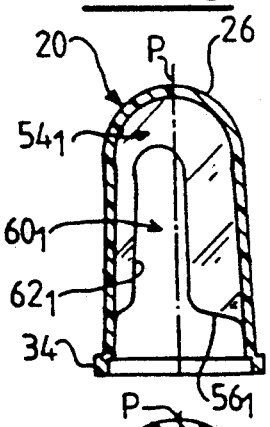
FIG.4
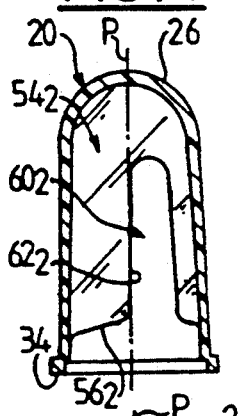
FIG.5
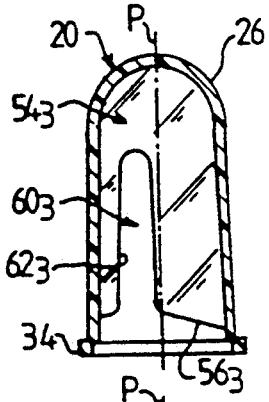
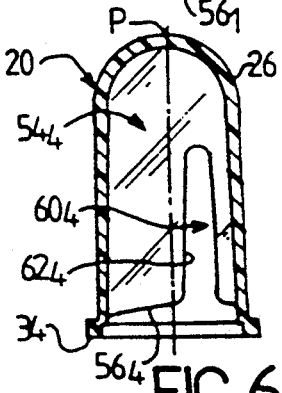
FIG.6
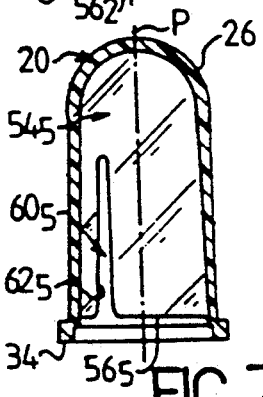
FIG.7
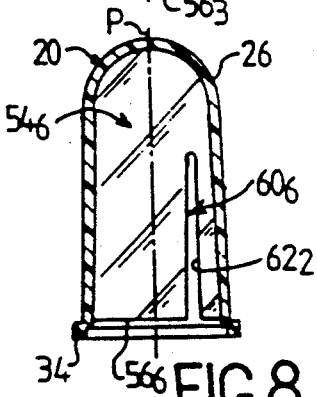
FIG.8
FIG.9
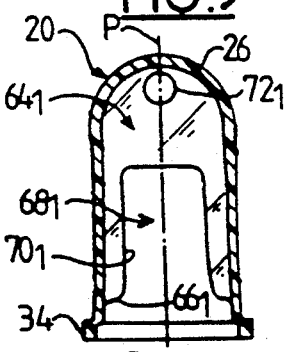
FIG.10
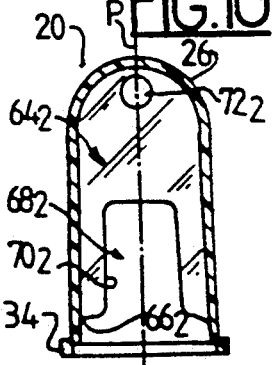
FIG.11
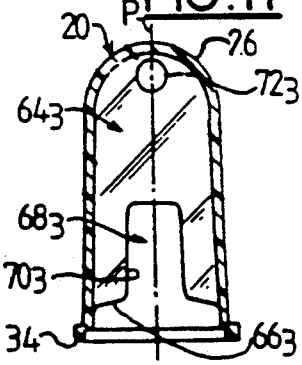
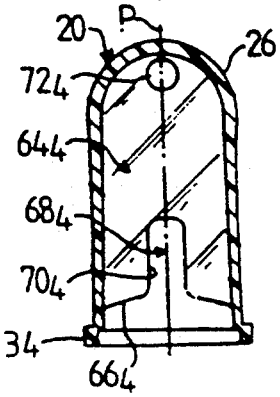
FIG.12
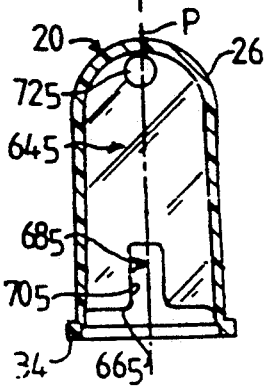
FIG.13
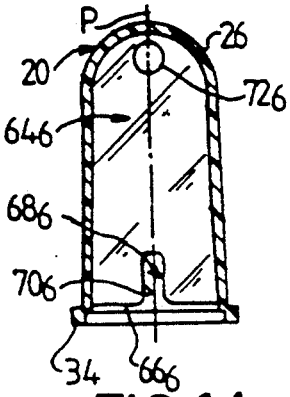
FIG.14

FLUID HEADER WITH AN INTEGRAL EXPANSION CHAMBER FOR A HEAT EXCHANGER, IN PARTICULAR FOR A MOTOR VEHICLE

FIELD OF THE INVENTION

This invention relates to heat exchangers, especially though not exclusively to radiators for use in a cooling circuit of an internal combustion engine in a motor vehicle, the heat exchanger having a fluid header with integral expansion chamber. The invention also relates to such a header, including a header body or casing; and to the header body itself.

BACKGROUND OF THE INVENTION

It is already known, from the specification of French published Patent Application FR2443657A, to provide a water header of this type which has an elongated open face and which is adapted to be assembled over a header plate or collector which is arranged in a substantially horizontal position, such that a liquid can flow in the header between a first end and second end of the latter, with the liquid covering the header plate.

Such a water header is adapted to be sealingly connected to the upper end of a heat exchanger body, which typically consists of a bundle comprising a multiplicity of heat exchange tubes arranged so as to extend generally vertically. The open face of the header body is then assembled on the header plate (or perforated plate), in which the upper ends of the tubes in the bundle are sealingly received. The lower ends of the tubes are generally joined to another water header, through a header plate of the latter.

In the header described in the above mentioned French Patent Specification, removable transverse grids are provided, these being spaced apart between the two ends of the header, so that air which is entrained by the liquid flowing in the heat exchanger can become separated from the liquid in the chambers which are defined between these grids. In this way, such a header enables the liquids flowing in the heat exchanger to be de-gassed, this liquid commonly being the cooling liquid for an internal combustion engine. The gases separated from the liquid then accumulate in the upper part of the fluid header, which also serves as an expansion vessel or chamber.

However, this known type of water header has a certain number of drawbacks. First of all, it is expensive to make, because it requires the provision of the grids which have to be fitted into the header body before the latter is assembled onto the header plate of the heat exchanger. In addition, because each of these grids is in the form of a mesh having a large number of holes, it tends to encourage the formation of bubbles which are detrimental to proper functioning of the heat exchanger. Furthermore, these grids give rise to energy losses in the flow of the liquid in the heat exchanger.

DISCUSSION OF THE INVENTION

The principal object of the invention is to overcome the above mentioned disadvantages.

Another object of the invention is to provide a water header of the kind defined in the section "Field of the Invention", which may be made in a particularly simple way, and which avoids the need to provide separate components which must be fitted within the body of the header.

A further object of the invention is to provide such a header which does not give rise to turbulence or similar disturbance, and which in particular reduces energy losses in operation of the heat exchanger.

Yet another object of the invention is to provide such a header which is especially suitable for use in heat exchangers for motor vehicles.

With these objects in view, according to the invention, a water header of the type defined under "Field of the Invention" above includes a plurality of transverse baffles formed integrally with the header body, these baffles being disposed in spaced-apart relationship between the first and second ends of the header body, with each baffle extending to a free terminal edge of the baffle situated close to the open face of the header body, the said baffles being formed with respective openings having flow cross sections which are of decreasing area from one baffle to the next going from the first end to the second end of the header body.

Since such a header body can be made as a single component, it is particularly simple and inexpensive to make.

The transverse baffles define within the header body a number of chambers, having respective sides which are open towards the open face of the header body. These chambers are in communication with each other through their respective open sides, and also through the above mentioned openings formed in the baffles.

The fact that the respective openings in the baffles have decreasing flow cross sections from the first end to the second end of the header body, that is to say in the same direction as that in which the fluid flows in the header, provides a breaking effect on the displacement of the liquid in the header while the vehicle is in motion, and also avoids any introduction of air. In addition, the air or gases entrained by the liquid are separated from the latter and accumulate in the upper part of the header, that is to say in the upper parts of the chambers defined by the transverse baffles.

In addition to the above, the baffles act as internal strengthening ribs, enabling the header body to withstand internal pressure.

In a preferred embodiment of the invention, the opening formed in each baffle intercepts the free edge of the latter. Thus, the opening is here simply defined by giving the free edge a suitable shape, which permits easy manufacture by moulding without any need to provide a moulding core.

Preferably, the opening in each baffle is delimited by a U-shaped edge which is joined to the free edge of the baffle.

According to another preferred feature of the invention, the three edges of the baffle are separated from the open face of the header body by respective gaps, the width of which decreases in succession going from the first end of the header to its second end, that is to say in the direction in which liquid flows in the header. This arrangement also contributes to the reduction in energy losses within the header.

In one form of header body in accordance with the invention, the openings in the baffles are offset alternately with respect to a central plane which extends between the first end and the second end of the header and at right angles to the open face of the header body. This feature forces the liquid to follow a sinuous path within the header, and this facilitates degassing.

In another form of header body in accordance with the invention, the openings in the baffles are aligned axially with respect to the central plane, and this has the advantage of reducing energy losses.

According to a further preferred feature of the invention, each of the baffles further includes a flow orifice formed through the baffle in a region of the latter which is remote from the open face of the header body. The presence of these flow orifices provides communication for air or gasses between the chambers which are defined between the baffles, thus equalising the pressure in all of the chambers.

According to yet another feature of the invention, the header body is made as a single component by moulding in a suitable plastics material.

In another aspect, the invention also provides a heat exchanger comprising a header body as defined above, with its open face assembled on a header plate or collector in which the ends of the tubes of a tube bundle of the heat exchanger are sealingly received.

The description which follows, of preferred embodiments of the invention, is given by way of example only and with reference to the accompanying drawings.

BRIEF DESCRIPTION OF THE DRAWINGS

FIG. 3 is a view in transverse cross section taken on the line III—III in FIG. 2.

FIG. 4 is a view in transverse cross section taken on the line IV—IV in FIG. 2.

FIG. 5 is a view in transverse cross section taken on the line V—V in FIG. 2.

FIG. 6 is a view in transverse cross section taken on the line VI—VI in FIG. 2.

FIG. 7 is a view in transverse cross section taken on the line VII—VII in FIG. 2.

FIG. 8 is a view in transverse cross section taken on the line VIII—VIII in FIG. 2.

FIG. 9 is a view in cross section similar to FIG. 3 but showing another embodiment of water header in accordance with the invention.

FIGS. 9 to 14 are views in cross section, corresponding to FIGS. 4 to 8 respectively, but for the embodiment shown in FIG. 9.

DESCRIPTION OF PREFERRED EMBODIMENTS OF THE INVENTION

Figure 1:
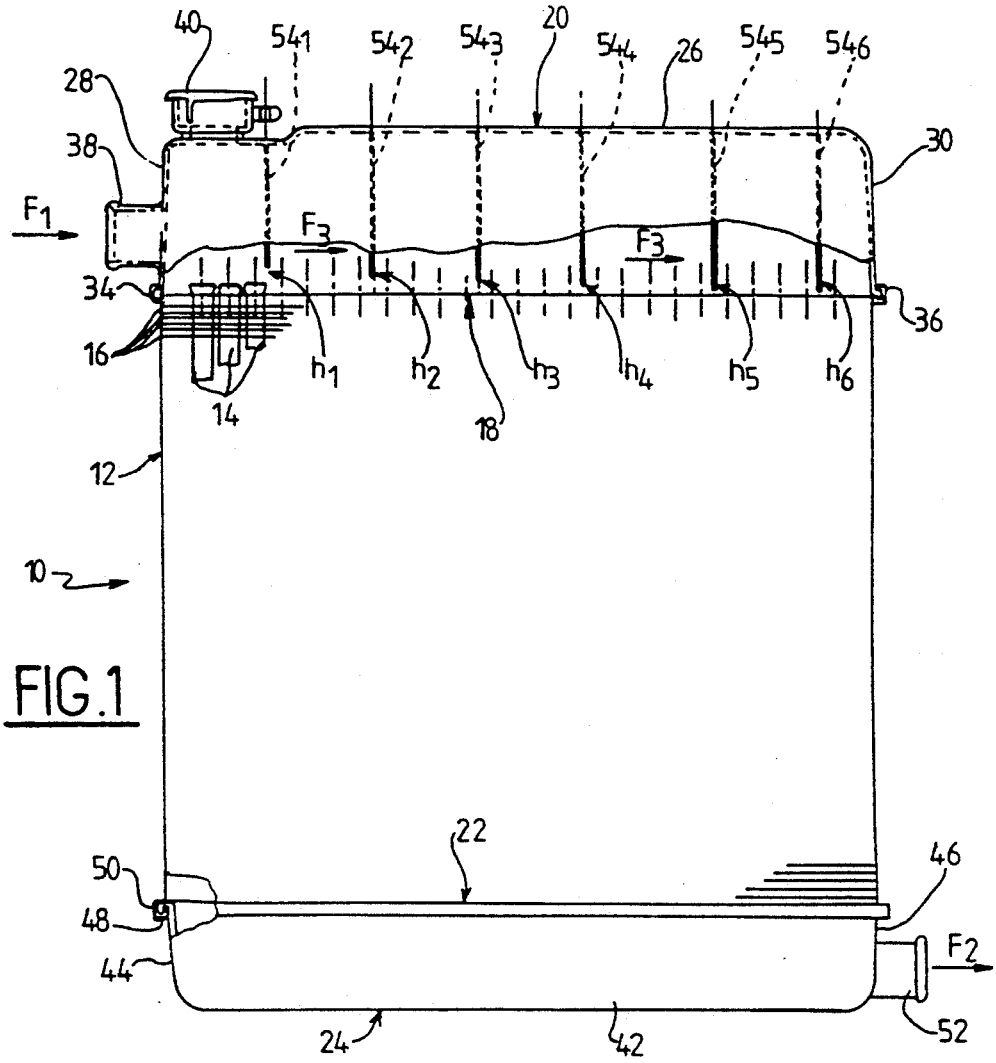
FIG. 1 is a view in elevation, shown partly cut away, of a heat exchanger that includes a water header with an integral expansion chamber in accordance with the invention.

Reference is first made to FIG. 1, which shows a heat exchanger 10 which typically comprises, for example, a radiator which is part of a cooling circuit for an internal combustion engine of a motor vehicle.

The heat exchanger 10 comprises a bundle 12 consisting of a multiplicity of parallel tubes 14 which extend in a generally vertical direction, and which pass through a matrix consisting of a multiplicity of cooling fins 16.

The fins 16 are parallel to each other and extend in a generally horizontal direction. The upper ends of the tubes 14 are sealingly received in a header plate or collector 18, which may also be referred to as a perforated plate, and on which a header body or casing 20 is mounted. The header body 20 and the header plate 18 together constitute a water header in the upper part of the heat exchanger. The lower ends of the tubes 14 are sealingly mounted in a further header plate 22, on which another header body 24 is mounted so as to constitute a lower header at the bottom end of the tube bundle 12.

The header body 20 (FIGS. 1 and 2) comprises a base wall 26 with the U-shaped profile shown in FIGS. 3 to 14, which is joined to a first end wall 28 and a second end wall 30. The walls 28 and 30 constitute the first and second ends respectively of the water header. The base wall 26 and the end wall 28 and 30 together delimit an open face 32 (FIG. 2) which is surrounded by a peripheral bead 34 of generally rectangular contour. The header plate 18 has peripheral lugs 36 (see FIG. 1) which are upset over the bead 34 in a conventional way.

The header body 20 is also formed with a stub tube 38 which projects from the first end wall 28. Liquid is admitted to the interior of the water header as indicated by the arrow F1 in FIG. 1. The header body 20 also has a filling port 40 which is provided with calibrated flap valves for correcting overpressure and underpressure.

The lower water header body 24 comprises a longitudinal wall 42 of U-shaped cross section joined to two end walls 44 and 46, these three walls delimiting an elongated open face which is bounded by a bead 48 of generally rectangular shape. The lower header plate 22 has a series of peripheral lugs 50, like the lugs 36 of the header plate 18, which are upset over the bead 48. The lower header body 24 also has a stub pipe 52 projecting from its end wall 46 for evacuation of liquid from the heat exchanger as indicated by the arrow F2 in FIG. 1.

To the extent to which it has just been described, the structure of the heat exchanger is known per se. The liquid to be cooled enters the upper water header body 20 through the stub pipe 38, and then flows through the tubes 14, being cooled in the usual way by heat exchange with air which is passed through the tube bundle 12. When the liquid reaches the lower header casing 24, it is then evacuated through the outlet stub pipe 52.

Figure 2:
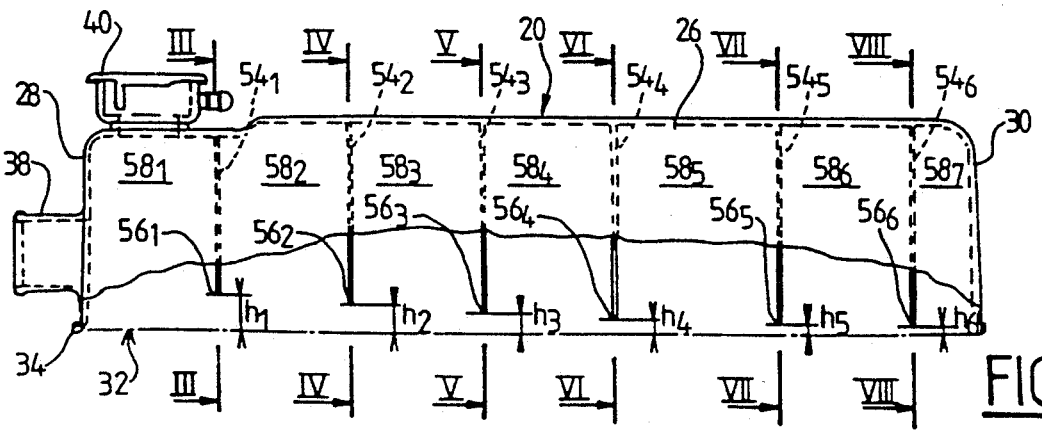
FIG. 2 is a view in elevation, again shown partly cut away and on a larger scale, of the same water header, with its integral expansion chamber, as is shown in FIG. 1.

The upper header body 20 is formed with a number of transverse baffles $54_1$ to $54_6$, of which there are six in this particular example, as shown in FIG. 2. These transverse baffles are formed integrally with the header body 20, for example by moulding in a suitable plastics material. The baffles 54 are spaced apart at equal or unequal intervals as desired, between the first end of the header (the end wall 28) and its second end at the end wall 30. In this particular example, the baffles 54 are parallel to each other, and extend from the U-shaped base wall 28 to a free edge of each baffle indicated at $56_1$ to $56_6$ respectively, which lies close to the open face 32 of the header casing 20, that is to say close to the associated header plate 18 when the latter is assembled to the casing 20. The free lower edges $56_1$ to $56_6$ are spaced away from the header plate 18 by gaps indicated at $h_1$ to $h_6$ respectively. The widths of these gaps progressively decrease going from the first end 28 to the second end 30, i.e. in the direction in which liquid flows within the water header, indicated by the arrow F3 in FIG. 1.

The baffles $54_1$ to $54_6$ thus, together with the various walls 26, 28 and 30 of the header casing, define seven chambers $58_1$ to $58_7$, which are open towards the associated header plate 18.

These chambers can communicate with each other through the gaps of width $h_1$ to $h_6$ respectively.

Referring now to FIGS. 3 to 8, the baffles $54_1$ to $54_6$ are formed with openings indicated at $60_1$ to $60_6$ respectively. Each of these openings has an edge $62_1$ to $62_6$ respectively, joined to the free edge $56_1$ to $56_6$ of the baffle. As can clearly be seen in the drawings, the openings 60 define passage cross sections which decrease in area going from the baffle $54_1$ lying closest to the first end wall 28 of the header to the last baffle $54_6$ lying closest to the second end wall 30.

In the particular embodiment shown in FIGS. 3 to 8, it will be noted that the openings $60_1$ to $60_6$ are offset alternately on opposite sides of the vertical center plane P extending between the two end walls 28 and 30, that is to say along the length of each baffle and at right angles to the open face 32 of the header body 20.

In operation, the liquid to be cooled enters the water header via the stub pipe 30, and flows inside the header casing 20 in the direction of the arrow F3, so that the header plate 18 is permanently covered with a layer of liquid of varying thickness. The header casing 20 extends over a height which is large enough to enable it to constitute an expansion chamber at the same time. This expansion chamber is adapted to maintain a certain amount of air or gas above the liquid in the header, that is to say at the top of the chambers $58_1$ to $58_7$. The header casing 20 also enables the liquid flowing in the heat exchanger to be degassed, by collecting gas or air bubbles in the top of the chambers 58. The openings 60 enable the liquid to flow freely between the various chambers $58_1$ to $58_7$. Due to the longitudinal alternating offsets of the openings 60, and their decreasing cross sectional area, the mass flow of the liquid is distributed between the various tubes 14 of the tube bundle with the minimum of energy loss.

Reference is now made to FIGS. 9 to 14, showing the modified embodiment. In this embodiment, the header casing 20 again has six baffles $64_1$ to $64_6$ which are joined to the base wall 26 and which extend to a free lower edge $66_1$ to $66_6$.The gap between the lower edge and the open face of the header body decreases in cross section going from the baffle $64_1$ lying closest to the end wall 28 to the baffle $64_6$ lying closest to the end wall 30. In this arrangement, the baffles 64 are formed with respective openings $68_1$ to $68_6$ which are defined by respective U-shaped edges indicated at $70_1$ to $70_6$. The U-shaped edges are joined to the free edges $66_1$ to $66_6$ of the baffles.

In this second embodiment, the openings 68 are aligned axially with the central plane P. In addition, the baffles $64_1$ to $64_6$ are formed with respective flow orifices $72_1$ to $72_6$, which are arranged in a region of the water header remote from the open face 32 of the header body, i.e. close to the U shaped base of the wall 26 of the latter. These orifices 72 are circular in shape, and enable gas to flow between the various chambers 58 of the header.

In the embodiment of the invention described above, the flow of liquid in the water header is distributed into the tubes of the bundle with minimal energy loss. The water header serves as an expansion chamber and also as a separator for gas bubbles, which collect in the top of the header. This degassing effect prevents the subsequent occurrence of gas bubbles in the coolant fluid after the latter has returned to the engine, which could form on the cylinder head and give rise to hot spots.

It will be realised that this water header is particularly simple to make, by moulding as a single component in an appropriate plastics material. In addition, the header body can be fitted in a conventional way on a heat exchanger body such as a bundle of tubes.

What is claimed is:

1. A heat exchanger having a fluid header with an integral expansion chamber, the header comprising a substantially horizontal header plate and a hollow header body overlying and secured to the header plate, the header body having at opposite ends thereof a first end wall and a second end wall and defining an elongated open face which is closed by the header plate, for flow of a liquid in the header between the said ends, wherein the header body has a plurality of integral transverse baffles spaced apart from each other between the said first and second end walls, each baffle having a free edge close to the said open face and an opening through the baffle defining a flow cross section, the respective said flow cross sections of the baffles being of decreasing area going from the said first end wall to the second end wall.

2. A heat exchanger according to claim 1, wherein each said opening intersects the free edge of the corresponding baffle.

3. A heat exchanger according to claim 1, wherein each said baffle defines a U-shaped edge joined to its said free edge and defining the corresponding said opening.

4. A heat exchanger according to claim 1, wherein the header body defines a gap between its open face and the free edge of each baffle, the widths of the said gaps being of decreasing magnitude from the baffle closest to the said first end wall to the baffle closest to the said second end wall.

5. A heat exchanger according to claim 1, wherein the header defines a central plane extending between its ends at right angles to the open face of the header body, the said openings in successive baffles being offset alternately on either side of the central plane.

6. A heat exchanger according to claim 1, wherein the header defines a central plane extending between the said ends at right angles to the open face of the header body, the openings in the baffles being aligned axially with the central plane.

7. A heat exchanger according to claim 1, wherein each baffle further has a through orifice in a region of the baffle remote from the open face of the header body.

8. A heat exchanger according to claim 1, wherein the header body is a single component of moulded plastics material.

9. A heat exchanger according to claim 1, further including a plurality of heat exchange tubes defining a bundle of tubes, with each tube being sealingly fitted in the header plate.

* * * * *